US006574826B1

(12) United States Patent
Turkal

(10) Patent No.: US 6,574,826 B1
(45) Date of Patent: Jun. 10, 2003

(54) VACUUM CLEANER FOR STATIONARY USE

(76) Inventor: Scott Turkal, 1814 E Avenue NE., Cedar Rapids, IA (US) 52402

( * ) Notice: Subject to any disclaimer, the term of this patent is extended or adjusted under 35 U.S.C. 154(b) by 0 days.

(21) Appl. No.: 09/929,959

(22) Filed: Aug. 15, 2001

(51) Int. Cl.[7] ..... A47L 5/38
(52) U.S. Cl. ..... 15/314; 15/339; 15/412
(58) Field of Search ..... 15/314, 339, 412

(56) References Cited

U.S. PATENT DOCUMENTS 3,240,000 A * 3/1966 Hayes et al. ..... 15/314
3,910,781 A * 10/1975 Bryant, Jr. ..... 15/314
4,202,070 A * 5/1980 Harfst ..... 15/314
4,754,519 A * 7/1988 Duran et al. ..... 15/312.1
4,805,255 A * 2/1989 Hed ..... 15/314
5,179,762 A * 1/1993 Wisnasky ..... 15/314

* cited by examiner

*Primary Examiner*—Theresa T. Snider
(74) *Attorney, Agent, or Firm*—Allan L. Harms

(57) ABSTRACT

A vacuum cleaner for stationary use includes a canister with an upper housing mounted to a lower housing. Openings in the bottom plate of the upper housing are generally in registry with apertures in the top cover of the lower housing. A gasket seals the abutment between the upper and lower housing. Each of the lower housing and the upper housing are of size and weight to allow their shipment by express or package delivery services. An access port to the interior of the upper housing is located in the sidewall of the upper housing behind the coin mechanism housing.

18 Claims, 4 Drawing Sheets

VACUUM CLEANER FOR STATIONARY USE

BACKGROUND OF THE INVENTION

The instant invention pertains to vacuum cleaners and in particular to coin operated, commercial vacuum cleaners which are stationary. Car wash facilities for consumer automobiles have typically included some provision for self service use of vacuum cleaning apparatus. Such devices have become revenue production devices with the inclusion of coin mechanisms to provide means for charging for use of the vacuum cleaning device. The proliferation of so-called "convenience" stores has also increased the demand for vacuum cleaning machines available to the public for use in cleaning interiors of motor vehicles of all kinds. Particularly in the setting of a "convenience" store, a stationary, coin-operated, self-service vacuum cleaner is desirable.

Existing vacuum cleaners are frequently made from sheet steel rolled into a cylindrical canister. A vacuum motor works upon the cavity of the canister to create a reduced air pressure within the canister in order to effect the desired suction through hoses styled to communicate with the canister's interior. Coin mechanisms are usually welded to the outside of the canister in order to make them convenient to the user and for appropriate connection to control the vacuum cleaning device.

The canister of the typical existing vacuum cleaner is somewhat bulky and heavy, the canister weighing over one hundred ten pounds and standing over forty-two inches tall. Because of the size and weight of an existing canister, freight by truck must be utilized to ship the vacuum cleaner and express and small package shipment cannot be used.

Additionally, typical canister come equipped with a coin mechanism housing which is welded to the canister sidewall. Further, existing canisters are equipped with two access doors through the sidewall of the canister, an upper one provided for access to the filtration bags within the canister and a lower one for access to the debris pan located at or near the bottom of the canister. The presence of two access doors leads to increased manufacturing cost and more opportunities for vandalism of the canister. When either access door is left open or damaged, the vacuum cleaner is rendered substantially nonfunctioning. A need exists for a canister which can be shipped at lower cost and which may be made with less susceptibility to vandalism.

BRIEF SUMMARY OF THE INVENTION

It is an object of the invention to provide a vacuum cleaner for stationary application such as at car wash facilities, which may be shipped by express delivery or package delivery services. Accordingly, the invention is a vacuum cleaner having a two-piece canister. The canister includes an upper housing which provides a mounting plate for blower motors, a coin mechanism housing mountable to the sidewall of the upper housing, and a bottom cover which is provided with at least one opening. A lower housing is mountable below the upper housing with a gasket ring between the upper housing and the lower housing to make the abutment between the upper housing and the lower housing substantially air tight. The lower housing includes a top cover with openings through it which register with the opening or openings of the bottom cover of the upper housing.

The lower housing includes a debris pan mountable near or at the bottom of the housing, along with brackets for securing the canister to a horizontal surface. An inlet opening is made in the sidewall of the lower housing to permit attachment of a vacuum hose. The openings in the top cover and the openings in the bottom cover allow filtration bags to be installed in an inverted fashion with the open ends of the filtration bags restrained below the top cover of the lower housing. The coin mechanism housing overlies an access opening in the sidewall of the upper housing which may be accessed when the coin mechanisms removed from the coin mechanism housing.

Further objects of the invention include (a) providing a vacuum cleaner for stationary mounting which has a hidden access opening which may only be accessed with the coin mechanism removed; (b) providing a vacuum canister which can be separated into separate units to reduce the risk of lifting injuries to a person installing or moving the vacuum cleaner; (c) providing an aesthetically pleasing vacuum cleaner which includes a band to overlie the mounting of the upper housing to the lower housing.

Another object of the invention is to provide a public-accessible vacuum cleaner for stationary application which has a hidden filtration bag access door, thereby reducing the incidence of nonfunctionality of the vacuum cleaner from misuse or vandalism.

These and other objects of the invention will become apparent from examination of the description and claims which follow.

BRIEF DESCRIPTION OF THE SEVERAL VIEWS OF THE DRAWING(S)

DETAILED DESCRIPTION OF THE INVENTION

Figure 1:
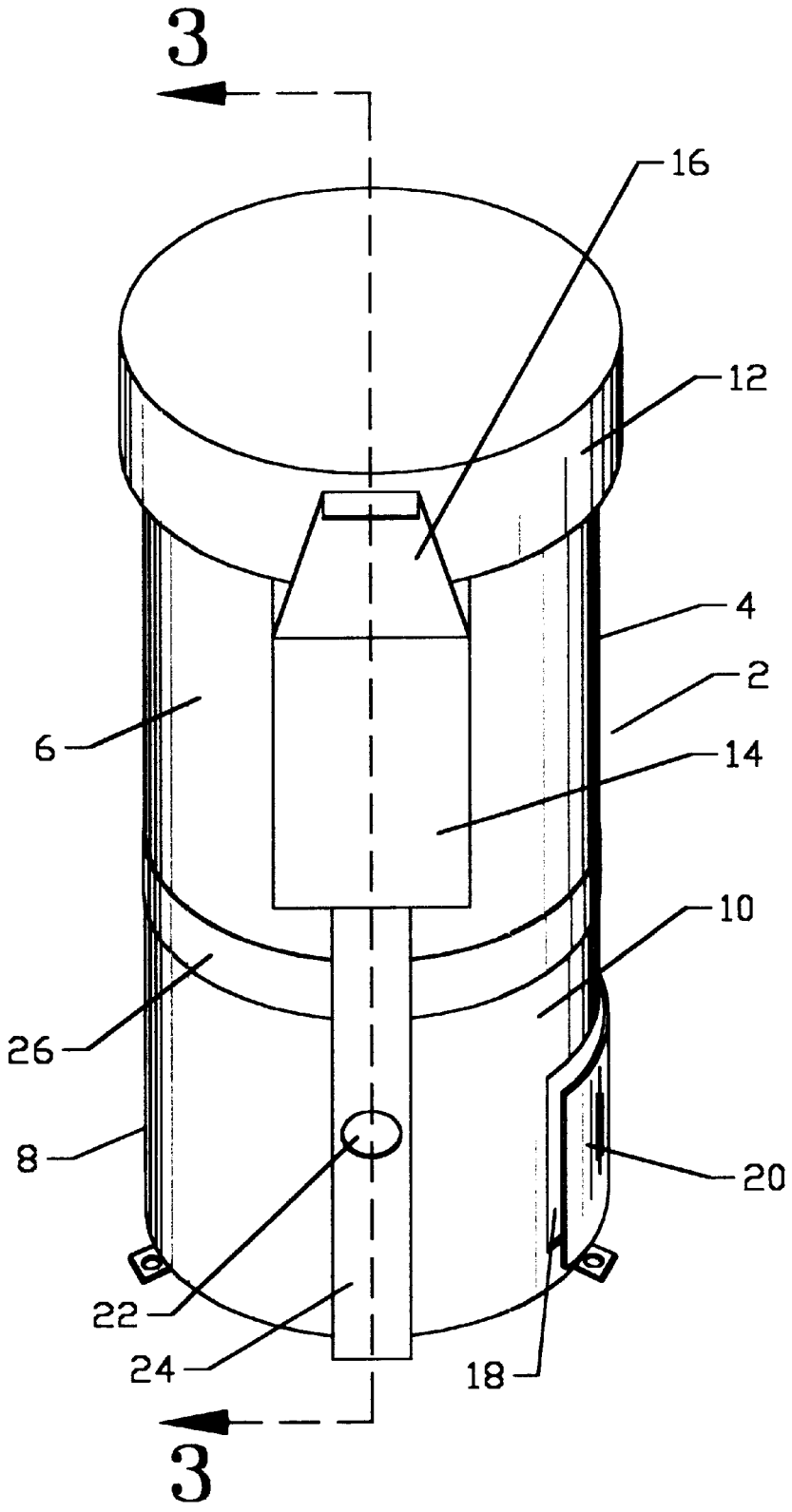
FIG. 1 is a front perspective of a vacuum cleaner for stationary placement at a location accessible to the public, embodying the invention.

Referring to the drawings, a vacuum cleaner 2 according to the present invention is illustrated in FIG. 1. The vacuum cleaner 2 comprises a lid 12 removeably attached to an upper housing 4 which mounts atop a lower housing 8. Preferably upper housing 4 and lower housing 8 are generally similar in size and weight so each may be shipped by express delivery services or by package handling services. Upper housing 4 comprises a sidewall 6 which in the illustration of the preferred embodiment is a steel sheet rolled into a cylindrical, vertically elongate hollow enclosure.

Fixed to upper housing 4 is a coin mechanism housing 14 which includes a bracket 16 extending therefrom to provide a storage location for a hose for the vacuum cleaner.

Disposed below upper housing 4 is lower housing 8 which may include a cylindrical, upright rolled steel sidewall 10. Lower housing 8 is provided with an access opening 18 through sidewall 10 which is overlain by an access door 20 hingedly mounted to sidewall 10. Vacuum inlet 22 communicates with the interior of lower housing 8 and is adapted to receive an end of a flexible hose coupled thereto.

A shroud 24 is removeably fastened to sidewall 10 of lower housing 8 and to sidewall 6 of upper housing 4.

Shroud 24 traverses band 26 which is provided to overlie the abutting ends of upper housing 4 and lower housing 8.

Figure 2:
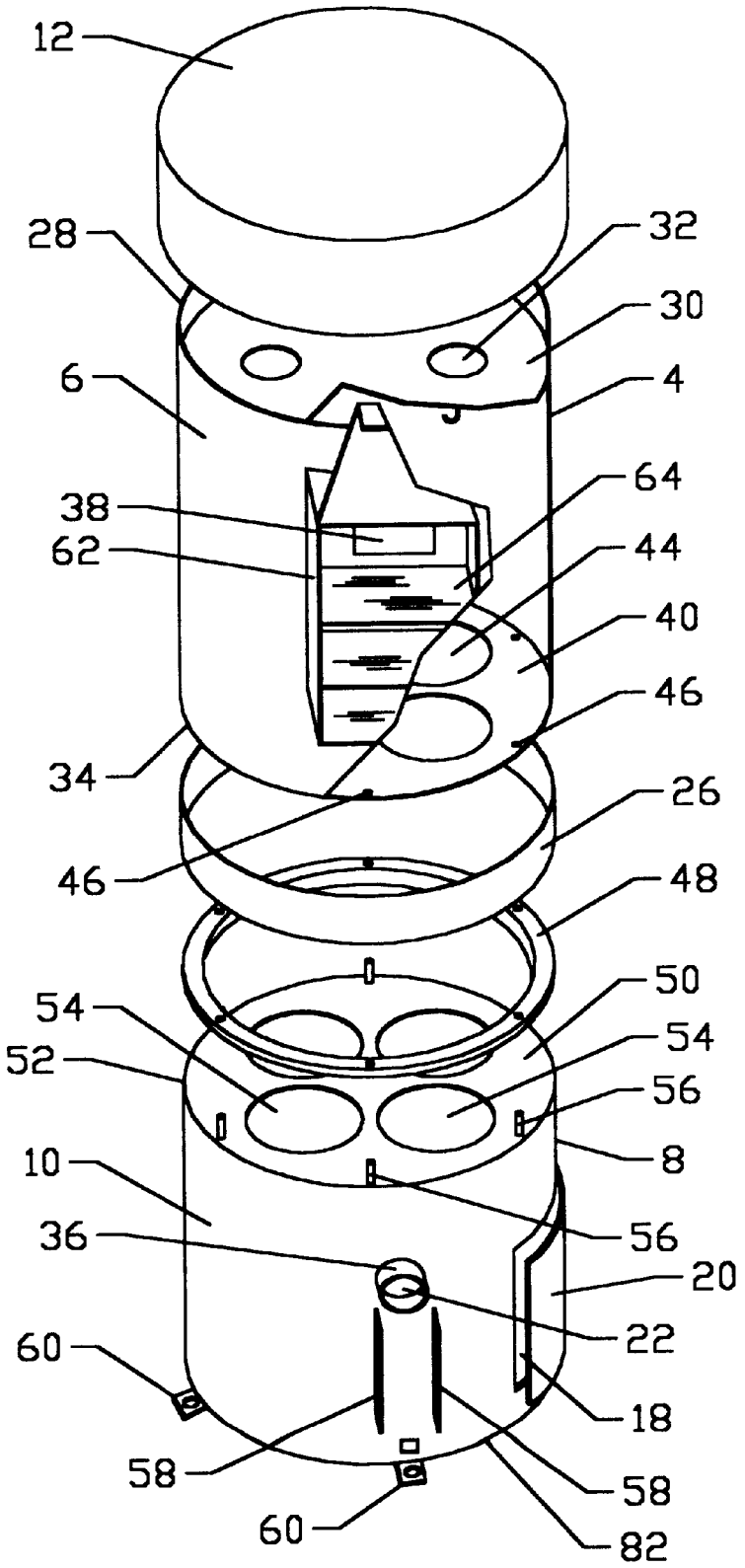
FIG. 2 is an exploded view in perspective, with portions cut away, of the preferred embodiment of the canister of the vacuum cleaner of the present invention.

The exploded perspective view of FIG. 2 illustrates that upper housing 4 is provided with blower mounting plate 30 mounted within sidewall 6 and spaced apart from top end 28 of upper housing 4. Blower mounting plate 30 is adapted for mounting blowers 78 thereon. Apertures 32 are provided through blower mounting plate 30 to allow air to be drawn from below blower mounting plate 30 by the action of blowers 78 which exhaust through constricted spaces between lid 12 and the top end 28 of upper housing 4.

Upper housing 4 is provided with bottom cover 40 securely mounted in generally airtight fashion, such as by welding, to sidewall 6 to enclose the lower end 34 of sidewall 6. Bottom cover 40 comprises one or more openings 44 therethrough such that a filtration bag 42 may extend through each of openings 44.

Lower housing 8 is disposed to allow upper housing 4 to be mounted thereon, preferably such that lower housing 8 is coaxial with upper housing 4 with sidewall 6 thereof vertically aligned with sidewall 10 of lower housing 8, for aesthetic reasons. However, the lower housing 8 and upper housing 4 could be arranged in couplings other than vertical and the shapes and sizes of each could vary widely.

Lower housing 8 has a top cover 50 which encloses upper end 52 of lower housing 8. Top cover 50 includes at least one aperture 54 therethrough. Aperture 54 must be located in top cover 50 such that it is at least partially in registry with the at least one opening 44 of bottom cover 40. Preferably, both top cover 50 and bottom cover 40 include identical numbers of openings 44 and apertures 54 and that each aperture 54 is in substantial registry with one of openings 44.

Mounting studs 56 upstand from top cover 50 to be received in stud holes 46 of bottom cover when upper housing 4 is placed atop lower housing 8, for secure abutting mount of upper housing 4 to lower housing 8.

A gasket 48 of generally resilient material is disposed between bottom cover 40 and top cover 50 to provide substantially airtight coupling of upper housing 4 to lower housing 8. In the preferred embodiment, gasket 48 comprises a one-inch wide ring constructed of closed cell foam which has an outer circumference which substantially conforms to the circumference of top cover 50 of lower housing 8. Alternative sealing means may be used in place of gasket 48 such as flowable curing sealants, metal and non-metal gaskets, or welding. Preferably upper housing 4 will be detachable from lower housing 8 if the need to relocate the vacuum cleaner 2 arises.

Band 26 is a rolled strip of sheet metal sized to encircle the lower end 34 of upper housing and the upper end 52 of lower housing 8 for cosmetic purposes. Inlet tube 36 comprises vacuum inlet 22 and extends from sidewall 10 of lower housing 8 sufficiently such that vacuum inlet 22 is generally coplanar with shroud 24. Blades 58 extend outward from lower housing 8 to provide supporting structure for shroud 24. Blades 58 are fixed to sidewall 10 and shroud 24 may be detachably mounted to blades 58.

Plural base mounting brackets 60 extend from lower end 82 to provide structure to bolt lower housing 8 to a support surface to make vacuum cleaner 2 stationary, such as near a car wash or at a convenience store.

Coin mechanism housing 62 defines a frame which is bolted to sidewall 6 of upper housing 4 and overlies upper housing access port 38. Coin mechanism housing 62 has an open back and includes shelves 64 on which a coin and time mechanism and coin box may be placed. A cover 80 is selectively placed over access port 38 before a coin mechanism is locked in place in coin mechanism housing 62.

Figure 3:
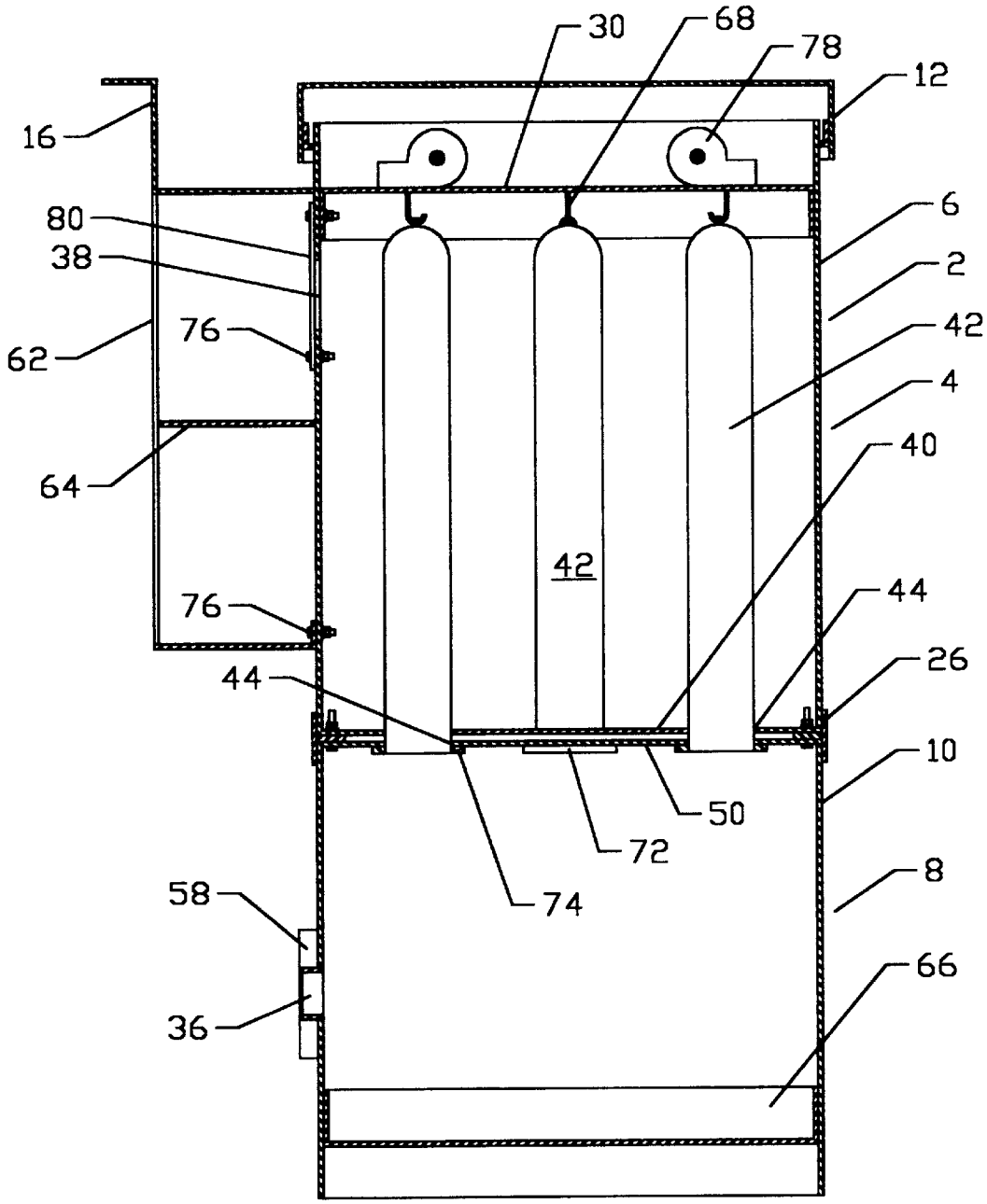
FIG. 3 is a cross section along lines 3—3 of FIG. 1.

FIG. 3 discloses the arrangement of filtration bags 42 within the preferred embodiment vacuum cleaner 2. Filtration bags 42 are suspended at their upper ends 70 by hooks 68 mounted to blower mounting plate 30. Lower ends 72 of filtration bags 42 are open and disposed below top cover 50 of lower housing 8. Lower ends 72 comprise semi-rigid lips 74 which restrain lower ends 72 of filtration bags 42 from passing through apertures 54 of top cover 50. A debris pan 66 rests at or near the bottom of lower housing 8 and may be accessed through access opening 18 of lower housing 8. Coin mechanism housing 14 is removeably mounted to sidewall 6 of upper housing 4 by bolts 76.

Figure 4:
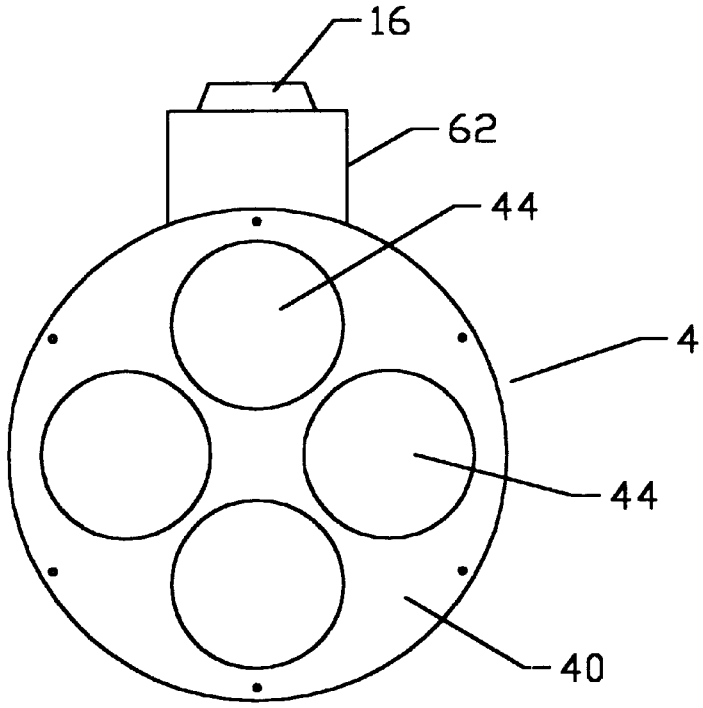
FIG. 4 is a bottom plan view of the upper housing of the vacuum canister of the invention.
Figure 5:
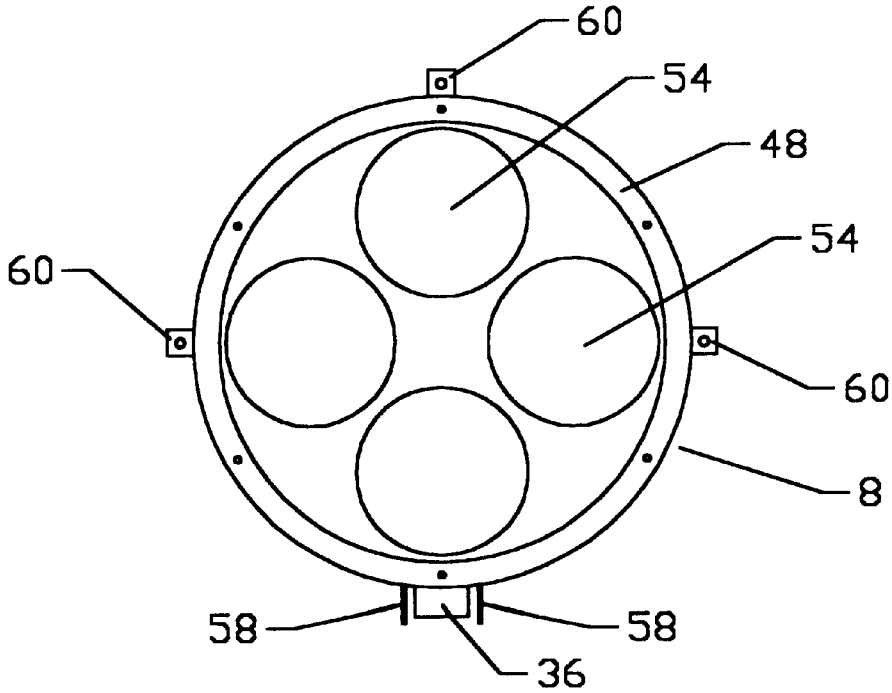
FIG. 5 is a top plan view of the lower housing of the vacuum canister of the invention.

FIG. 4 discloses the bottom cover 40 of upper housing 4. FIG. 5 shows the top cover 50 of lower housing 8. It can be seen in FIGS. 4 and 5 that openings 44 of bottom cover 40 and aperture 54 of top cover 50 are substantially in registry.

While a preferred embodiment of the invention is described above, it is contemplated that variations will be developed within the teaching of the present disclosure.

Having described the invention, I claim:

1. A vacuum cleaner for stationary mounting near a car wash comprising an upper housing having an upper end and a lower end and having a sidewall interconnecting the upper end and the lower end, the upper housing being vertically elongate and substantially hollow, a blower support plate mounted within the upper housing spaced apart from the upper end of the upper housing, the blower support plate having one or more openings therethrough, a bottom cover enclosing the lower end of the upper housing, the bottom cover having one or more openings therethrough, a lower housing having a sidewall interconnecting an upper end and a bottom end thereof, the lower housing being vertically elongate and substantially hollow, a debris collection pan disposed within the lower housing near the bottom end thereof, an inlet port through the sidewall of the lower housing, the lower housing having a top cover closing the upper end thereof, the top cover having one or more apertures therethrough, each of the one or more apertures of the top cover of the lower housing generally in registry with a one of the one or more openings of the bottom cover of the upper housing, a gasket disposed between the top cover of the lower housing and the bottom cover of the top housing, a lid overlying the upper end of the upper housing, the lid selectively mounted to the upper housing and sized to permit constricted flow of air from the upper end of the upper housing.

2. The vacuum cleaner of claim 1 wherein a mechanism housing for receiving a control mechanism is detachably mounted to the sidewall, the mechanism housing having sidewalls and an open back.

3. The vacuum cleaner of claim 2 wherein the sidewalls of the mechanism housing define an area on the sidewall of the upper housing, the sidewall of the upper housing comprises an access port therethrough, the access port disposed in the area defined by the sidewalls of the mechanism housing.

4. The vacuum cleaner of claim 3 wherein an access cover is selectively disposed to overlie the access port.

5. The vacuum cleaner of claim 1 wherein the upper housing is detachably mounted atop the lower housing.

6. The vacuum cleaner of claim 1 wherein one or more filtration bags are disposed within said upper housing, each of said one or more filtration bags received within one of said openings of said bottom cover and within a corresponding one of said apertures in said top cover, hook members depend from said blower mounting plate, each of said fabric filtration bags detachably hung from one of said hook members, each of said filtration bags having an open end, said open end of each of said filtration bag retained below said top cover of said lower housing.

7. The vacuum cleaner of claim 1 wherein the gasket comprises a ring of resilient material, the gasket has a periphery which conforms generally to the periphery of the top cover of the lower housing.

8. The vacuum cleaner of claim 7 wherein the upper housing is detachably mounted atop the lower housing, the sidewall of the upper housing substantially vertically aligned with the sidewall of the lower housing, the upper housing and the lower housing of generally similar height, a mechanism housing for receiving a control mechanism is detachably mounted to the sidewall, the mechanism housing having sidewalls and an open back, the sidewalls of the mechanism housing define an area on the sidewall of the upper housing, the sidewall of the upper housing comprises an access port therethrough, the access port disposed in the area defined by the sidewalls of the mechanism housing, an access cover is selectively disposed to overlie the access port, one or more filtration bags disposed within said upper housing, each of said one or more filtration bags received within one of said openings of said bottom cover and within one of said apertures in said top cover, hook members depending from said blower mounting plate, each of said fabric filtration bags detachably hung from one of said hook members, each of said filtration bags having an open end, the open end of each of said filtration bags retained below said top cover of said lower housing, a band overlying the lower end of the upper housing and the upper end of the lower housing, the sidewall of the lower housing comprises an access door to permit access to the debris collection pan for removal of debris collected therein.

9. A vacuum cleaner for stationary placement at a location accessible to the public comprises a first housing adapted for mounting of at least one blower and enclosing a first space, a second housing adapted for placement adjacent the first housing and further adapted for receiving debris therein through an inlet port therein, the second housing enclosing a second space, the first space in substantially air tight communication with the second space, the first housing having a lower closed end with at least one opening therein, the second housing having an upper closed end with at least one aperture therein, the at least one opening of the lower closed end of the first housing substantially in registry with the at least one aperture of the upper closed end of the second housing.

10. The vacuum cleaner of claim 9 wherein the first housing has a sidewall, the first housing including an access port through the sidewall, a mechanism housing mounted to the sidewall, the mechanism housing comprising an open frame, the frame defining an area on the sidewall of the first housing, the access port disposed within the area defined by the frame of the mechanism housing.

11. The vacuum cleaner of claim 10 wherein the mechanism housing is detachably mounted to the sidewall of the first housing.

12. The vacuum cleaner of claim 11 wherein the first housing is similar in size to the second housing, the second housing having a sidewall, the first housing disposed atop the second housing, the sidewall of the first housing substantially vertically aligned with the sidewall of the second housing.

13. The vacuum cleaner of claim 12 wherein a seal is disposed between the first housing and the second housing.

14. A canister for a vacuum cleaner for stationary placement comprising a first housing adapted for mounting of at least one blower and enclosing a first space, a second housing adapted for placement adjacent the first housing and further adapted for receiving debris therein through an inlet port therein, the second housing enclosing a second space, the first space in substantially air tight communication with the second space, the first housing having a lower closed end with at least one opening therein, the second housing having an upper closed end with at least one aperture therein, the at least one opening of the lower closed end of the first housing substantially in registry with the at least one aperture of the upper closed end of the second housing.

15. A canister for a vacuum cleaner for stationary placement comprising a first housing adapted for mounting of at least one blower and enclosing a first space, a second housing adapted for placement adjacent the first housing and further adapted for receiving debris therein through an inlet port therein, the second housing enclosing a second space, the first space in substantially air tight communication with the second space, the first housing has a sidewall, the first housing including an access port through the sidewall, a mechanism housing mounted to the sidewall, the mechanism housing comprising an open frame, the frame defining an area on the sidewall of the first housing, the access port disposed within the area defined by the frame of the mechanism housing.

16. The canister of claim 15 wherein the mechanism housing is detachably mounted to the sidewall.

17. A canister for a vacuum cleaner for stationary placement comprising a first housing adapted for mounting of at least one blower and enclosing a first space, a second housing adapted for placement adjacent the first housing and further adapted for receiving debris therein through an inlet port therein, the second housing enclosing a second space, the first space in substantially air tight communication with the second space, the first housing is similar in size to the second housing, the second housing having a sidewall, the first housing disposed atop the second housing, the sidewall of the first housing substantially vertically aligned with the sidewall of the second housing.

18. A vacuum cleaner for stationary placement at a location accessible to the public comprises a housing having an upper end and a lower end and having a sidewall interconnecting the upper end and the lower end, the housing being vertically elongate and defining an interior space, an air movement assembly adapted to exhaust air from the interior space to the exterior of the housing, the housing having a plate mounted therewithin, the plate dividing the interior space of the housing into an upper region and a lower region, the plate having one or more openings therethrough, a debris collection pan disposed within the lower region near the bottom end of the housing, a mechanism housing mounted to the sidewall, the mechanism housing comprising an open frame, the frame defining an area on the sidewall of the first housing, an access port communicative with the upper region disposed within the area defined by the frame of the mechanism housing.

* * * * *